US011357274B2

(12) United States Patent
Balcarczyk

(10) Patent No.: US 11,357,274 B2
(45) Date of Patent: Jun. 14, 2022

(54) GLOVE

(71) Applicant: Regina Balcarczyk, Vettweiss (DE)

(72) Inventor: Regina Balcarczyk, Vettweiss (DE)

( * ) Notice: Subject to any disclaimer, the term of this patent is extended or adjusted under 35 U.S.C. 154(b) by 19 days.

(21) Appl. No.: 16/758,141

(22) PCT Filed: Oct. 10, 2018

(86) PCT No.: PCT/EP2018/077538
§ 371 (c)(1),
(2) Date: Apr. 22, 2020

(87) PCT Pub. No.: WO2019/081203
PCT Pub. Date: May 2, 2019

(65) Prior Publication Data

US 2020/0281291 A1 Sep. 10, 2020

(30) Foreign Application Priority Data

Oct. 25, 2017 (DE) ..... 20 2017 005 559.7

(51) Int. Cl.
*A41D 19/015* (2006.01)
*A41D 31/14* (2019.01)
*A41D 31/18* (2019.01)
*A41D 19/00* (2006.01)

(52) U.S. Cl.
CPC ... *A41D 19/01547* (2013.01); *A41D 19/0044* (2013.01); *A41D 31/14* (2019.02); *A41D 31/18* (2019.02)

(58) Field of Classification Search
CPC ..... A41D 19/01547; A41D 19/0044; A63B 71/148
See application file for complete search history.

(56) References Cited

U.S. PATENT DOCUMENTS

| | | | | |
|---|---|---|---|---|
| 4,103,362 | A | 8/1978 | Blakeman | |
| D553,301 | S | 10/2007 | Van Buren | |
| D595,929 | S * | 7/2009 | Brown | D2/617 |
| 9,003,569 | B2 * | 4/2015 | Ramirez | A41D 19/01523 2/163 |
| 2004/0177430 | A1 | 9/2004 | Gordon | |
| 2007/0079421 | A1 | 4/2007 | Davis | |
| 2013/0180022 | A1 * | 7/2013 | Baungartger | A41D 13/087 2/16 |
| 2014/0189925 | A1 | 7/2014 | Ramirez | |

* cited by examiner

*Primary Examiner* — Tajash D Patel
(74) *Attorney, Agent, or Firm* — Harness, Dickey & Pierce, P.L.C.

(57) ABSTRACT

A glove having three receiving tubes for a thumb, an index finger and a middle finger of a hand, which tubes are joined together and are combined together with a region adjacent to the edge of the thumb on the hand to form a wrist cuff so that a cut-out remains which exposes a ring finger, a little finger, an edge of the hand and the adjacent regions of the palm and the back of the hand, which cut-out is seamed at least in sections in a stabilising manner.

11 Claims, 4 Drawing Sheets

GLOVE

CROSS-REFERENCE TO RELATED APPLICATIONS

This application is a 371 U.S. National Phase of International Application No. PCT/EP2018/077538, filed on Oct. 10, 2018, which claims the benefit of German Patent Application No. 20 2017 005 559.7, filed on Oct. 25, 2017. The entire disclosures of the above applications are incorporated herein by reference.

FIELD

The present disclosure relates to a glove for different application cases.

BACKGROUND

This section provides background information related to the present disclosure which is not necessarily prior art.

Gloves are worn for a plurality of activities. On the one hand, they are worn for protecting fingers and hands, they are thus so-called working gloves. These ones play a role both during manual works and for example during gardening works and the like. Furthermore, gloves are used in order to prevent the transmission of sweat, dirt and the like onto goods to be processed.

Another aspect is that gloves often fulfil mixing functions. They shall protect the goods, on the one hand, and the fingers, on the other hand. Furthermore, they shall assist the hand in lengthy and delicate works and nevertheless be comfortable, and for example counteract unnecessary sweating.

The example of so-called quilting will explain the problem in the following.

During the mechanical free-motion quilting three fabric layers (these ones are two fabric layers and a layer of volume-fleece) are placed under the needle of the sewing machine and uniformly displaced with the hands, in order to sew the three fabric layers together by means of a pattern seam. Herein, the hands are each placed on one side of the quilt approximately at a distance of 5 cm from the sewing foot.

During the mechanical free-motion quilting it is important to assure precision and thus a uniform manual guidance. Furthermore, the manufacture of quilt products is a very lengthy working process. This means that the hands require a certain grip on the three fabric layers, in order not to slip off. Simultaneously, a certain mobility is required, in order to be able to sew the sometimes highly squiggled patterns, which at the same time connect the three fabric layers to each other.

For facilitating the work, special gloves are available on the quilt market, such as for example Handi Quilter (https://naehwelt-flach.de/Zubehoer/ Handi-Quilter-Quilt-Handschuhe-M-L.html) or for example Quilting Grip Gloves (https://www.quiltzauberei.de/zubehoer-garne-kurzwaren/sonstige-kurzwaren-schneidereibedarf/quilthandschuhwefons-porter-machine-quilting-grip-gloves.html) or Machingers Quilting Gloves https:// leahday.com/products/machngers-quilting-gloves. With these products the manufacturers aim at the result that the fabric can be held and guided more easily by means of the gloves. Special grip points on the inner side of the gloves shall permit a better control over the thread guide on the fabric.

However, these quilt gloves are designs having defects. On the one hand, the fabric is still too thick and not sufficiently supple for a precise free-motion quilting. Simultaneously it is not possible in the long run to assure both the control over the hand movements and the required flexibility for sewing the patterns.

Another problem is that the hands are sweating under the fabric, which negatively affects the working to a large extend. Therefore, these design models hardly make it possible to carry out quilting works continuously over a longer time, since during the realization of the quilting work it will get warm beneath the fabric and working with sweating hands is uncomfortable. Therefore, one has to take off the gloves regularly, in order to air the hands.

Since quilting on a quilt product usually requires a longer period of time, the already existing models only support the working process in a limited manner. The grip points alone or the slip-proof fabrics on the inner side of the gloves are not sufficient for assuring a comfortable quilting. It is especially the wear comfort of these glove designs which is unsatisfying. This type of gloves forces the quiltmakers to take them off periodically, in order to let air get to the hands. This in turn leads to a regular interruption of the quilting work. Thereby the already complex and lengthy quilting work is even more protracted.

For lack of options quilters recommend on quilt-online-fora or in quilt courses to use gardening gloves (provided that they have a rubber coating) from the construction market as a temporary solution. Quilters thus work basically with gloves which only serve the purpose in a limited manner, namely they facilitate to hold and displace the fabric under the needle of the sewing machine.

However, it is very clear that comparable problems also exist in other fields. The above described problems principally exist for each kind of sewing, wherein it is desirable to be able to adapt the glove with respect to the material to the task and the fabric to be processed in a simple manner.

In case of a high plurality of relevant tasks it is desirable to protect the working fingers, on the one hand, and to leave some fingers free, on the other hand, in order to get for example a feeling for the material or to be able to realize certain working operations.

It is for example obvious that in common shops users of games consoles always work with the same fingers on the consoles. Last, but not least this can cause unhygienic situations due to sweating and the like. It is desirable here to be able to counteract any sweating, on the one hand, and to protect the device, on the other hand.

A similar problem arises during completely different activities in the field of electronics. Components usually have to be actuated with antistatic gloves. Antistatic gloves are however bad, if simultaneously a computer shall be operated via a pad or the like. Touchscreens can neither be operated with antistatic gloves.

For a plurality of application cases it is thus desirable to be able to use a glove made of an especially light material, but which protects the hands and the material to be processed, on the one hand, and to have the hand as free as possible, in order to prevent possible sweating, on the other hand. Finally, it should also be possible to leave some fingers free, in order to realize tasks where gloves are disturbing.

SUMMARY

This section provides a general summary of the disclosure, and is not a comprehensive disclosure of its full scope or all of its features.

Based upon the above described state of the art it is the object of the present disclosure to provide a glove which takes the different problems into account.

According to the disclosure it is provided to produce a glove having three receiving tubes for a thumb, an index finger and a middle finger. These tubes are joined together and are in turn arranged at a region which only covers the edge of the thumb of a hand. A cuff is formed in the area of the wrist. Advantageously, the cut-out generated in this manner is so large that it exposes a big part of the palm and the corresponding part of the back of the hand. The edge of the hand as well as the ring finger and the little finger are also free. The entire cut-out is advantageously seamed at least in sections in a stabilising manner. In this way, it is possible to make the glove of an especially light and fine material.

A glove according to the disclosure covers the three working fingers, the thumb, the index finger and the middle finger, it protects the fingers themselves, on the one hand, and enables to process material with these fingers, on the other hand, which material is also automatically protected.

The remaining part of the hand is completely free and can for example be exposed to the air, and due to the free fingers it can be used for developing or using a corresponding feeling.

The glove according to the disclosure can also be pulled off the fingers in a simple manner and be held ready while remaining at the wrist by means of the cuff. This can be for example required, if free fingers are necessary for especially delicate works or if the glove material shall not be polluted during breaks and the like.

A light breathable material is used as material for the glove. For special application cases, for example in the field of cosmetics, the material can also be a paper fibre material. Such three finger gloves can be configured as disposable gloves. The material can be antistatic, elastic or can also vary. Thus, for example especially protective materials can be combined with highly breathable materials, with membranes, chemically resistant portions and the like.

The cuff is advantageously elastic. This can be for example obtained by fixing an elastic band.

The cuff can also be open and comprise a closable strap. This one can for example comprise a Velcro fastener.

According to another advantageous proposal of the disclosure the outer sides of the receiving tubes, provided that they are oriented towards the palm, can be at least partially coated with an anti-slide material, for example with rubber studs.

Reinforcements can be formed in the area of the fingertips, for example for gaming gloves, in order to counteract wear.

The seaming of the cut-out can be elastic, in order to favour a simple putting on and pulling off of the glove.

Since for example for the free-motion quilting only three fingers per hand are required, a glove having three fingers only is useful. During the quilting work only the thumb, the index finger and the middle finger displace the fabric under the needle of the sewing machine. A glove having only three fingers is overall lighter, offers more freedom of movement and the hands do not sweat. Additionally the following features are also obtained: the three-finger quilting glove is made of a light breathable fabric and comprises a rubber coating on the inner surfaces of the fingers (thumb, index finger and middle finger). The cuff is preferably provided with an elastic band or an adhesive band.

Since it is required in the free-motion quilting to permanently draw and move the fabric in different directions, the hands become quickly tired. The three-finger quilting gloves however counteract an exhaustion by facilitating the drawing and displacement of the fabric, since they altogether weigh less and the hands do not sweat. Furthermore, the fabric layers to be sewn are much easier to grip due to the especially light and breathable fabric of the three-finger quilting gloves. Furthermore, the three-finger quilting gloves can be taken off without any problems thanks to the light elastic material, in order to adjust the sewing machine, for example or to insert the thread or the like.

For preventing the hands from sweating and getting tired during the mechanical free-motion quilting and for assuring that the fabric can be easily moved by the hands under the sewing foot, a three-finger glove is proposed which only covers the thumb, the index finger and the middle finger and in which the fabric extends along the base of the middle finger and along the palm perpendicularly into the direction of the wrist and terminates with a cuff that preferably comprises an elastic band or a Velcro strap at the wrist. The ring finger and the little finger thus remain free of fabric. The fabric on the finger surfaces is made of a slip-proof material, preferably a rubber coating. The fabric of the glove is altogether light and breathable.

The disclosure proposes a variously usable glove, which comprises respectively optimized characteristics and which almost solves the initially described problems.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Other advantages and features of the disclosure will become apparent from the following description by means of the figures. Herein:

Corresponding reference numerals indicate corresponding parts throughout the several views of the drawings.

In the figures, the same elements have the same reference numerals.

DETAILED DESCRIPTION

Figure 1:
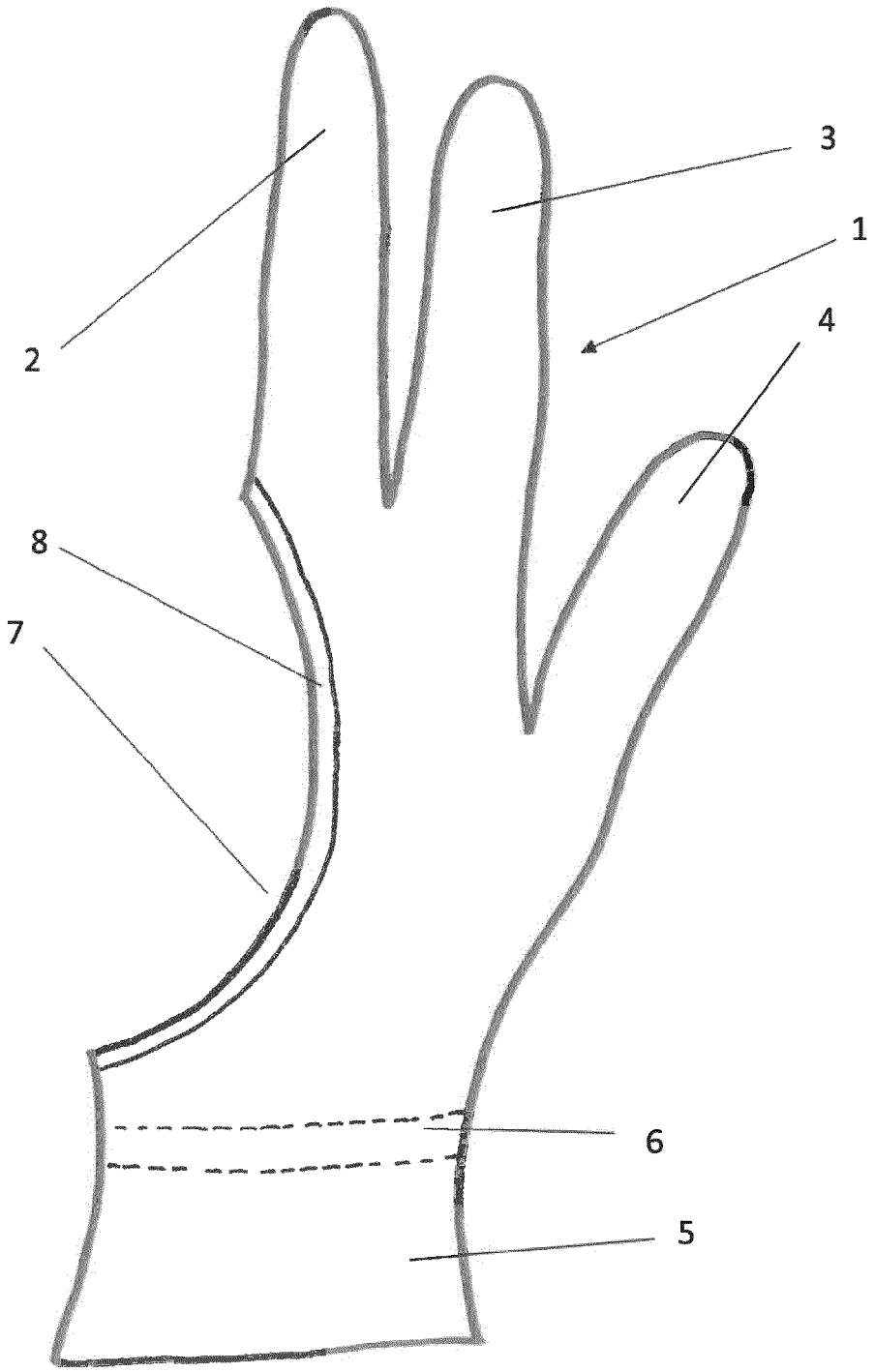
FIG. 1 shows a top view of an exemplary embodiment of a glove according to the disclosure.

Example embodiments will now be described more fully with reference to the accompanying drawings.

According to the figures a glove 1 according to the disclosure comprises the receiving tubes 2, 3 and 4 for the middle finger, the index finger and the thumb of a hand. In the area 5 a cuff is formed, which comprises an elastic band 6 in the area of the cuff 5 according to FIGS. 1, 2 and 4.

Figure 2:
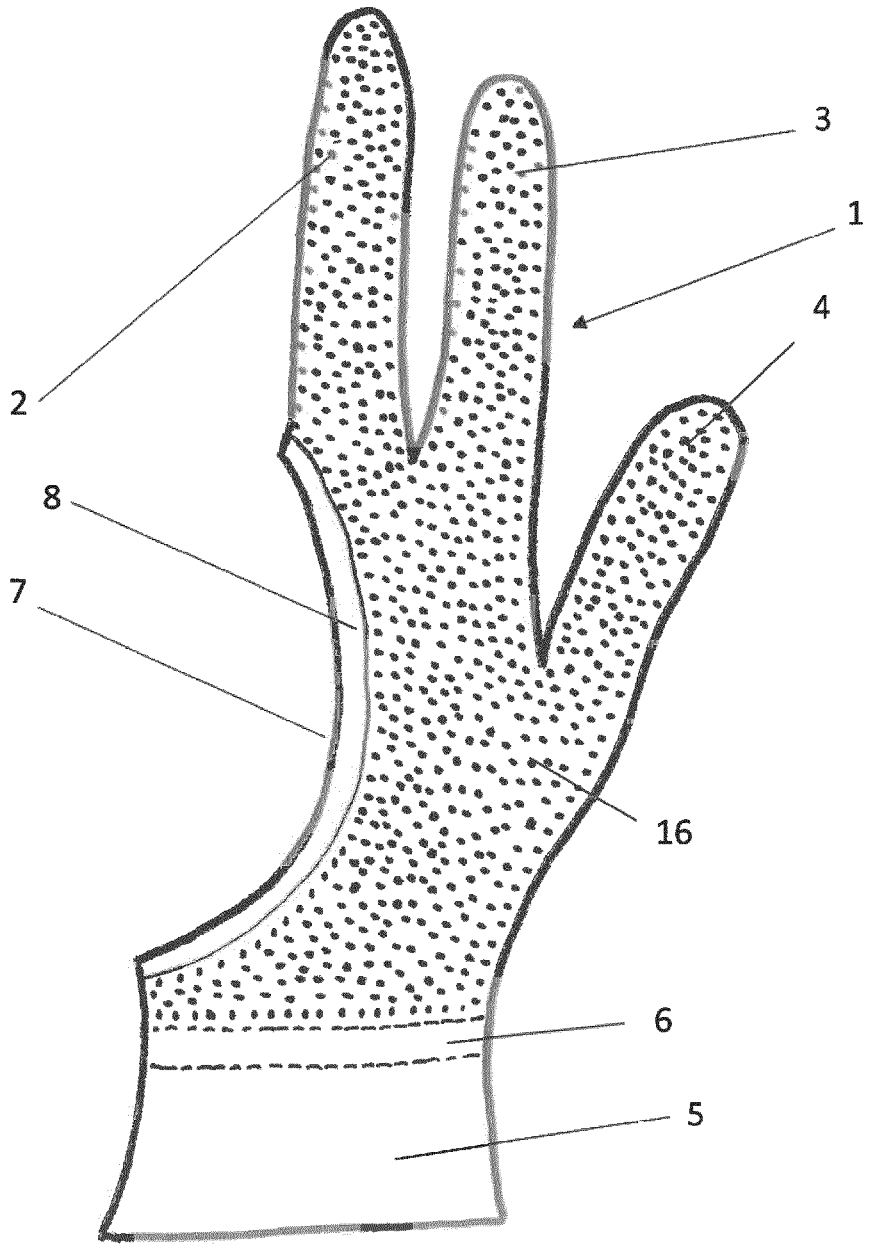
FIG. 2 shows an alternative embodiment of a glove according to FIG. 1.
Figure 3:
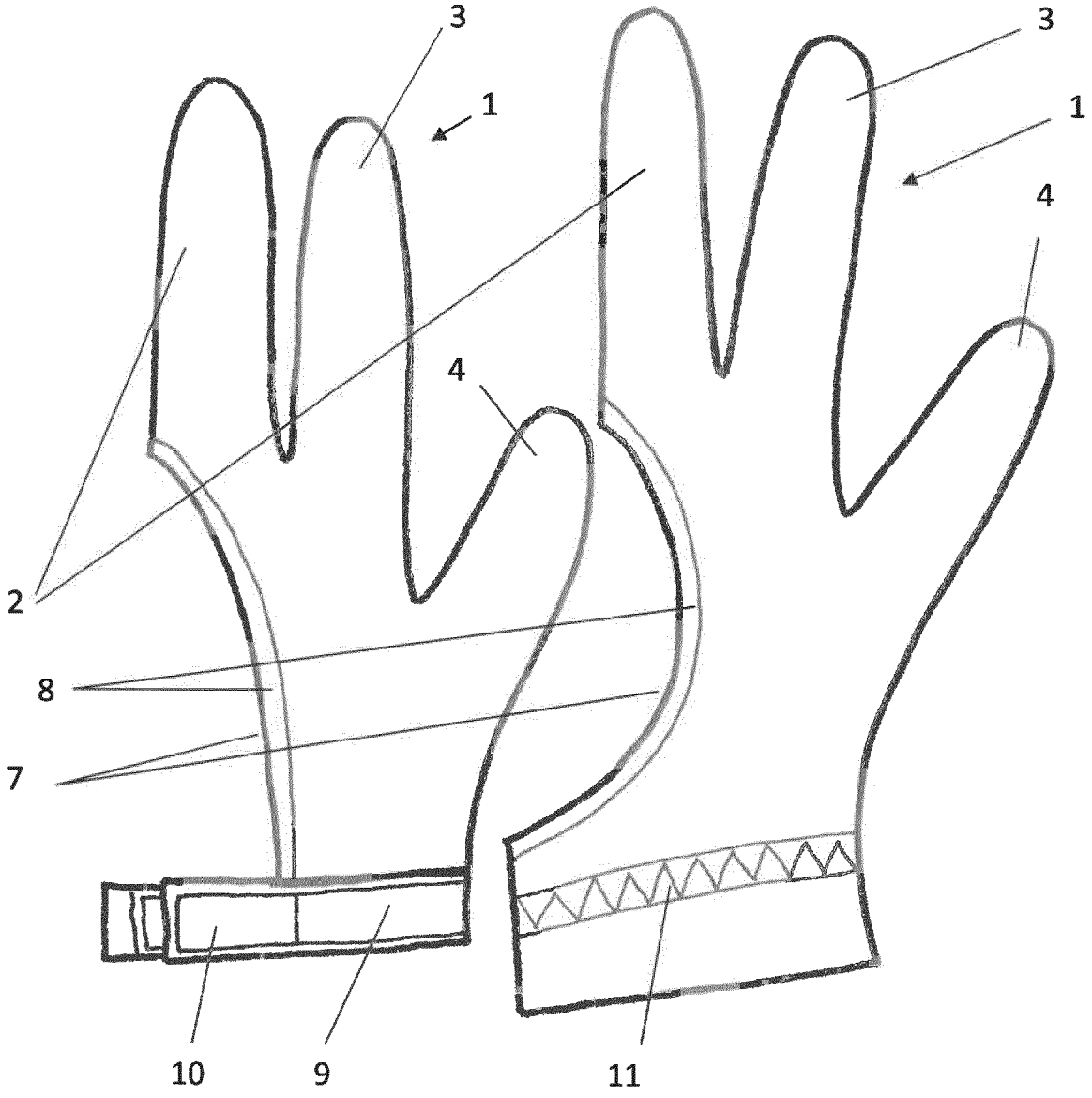
FIG. 3 shows other alternative embodiments of the glove.
Figure 4:
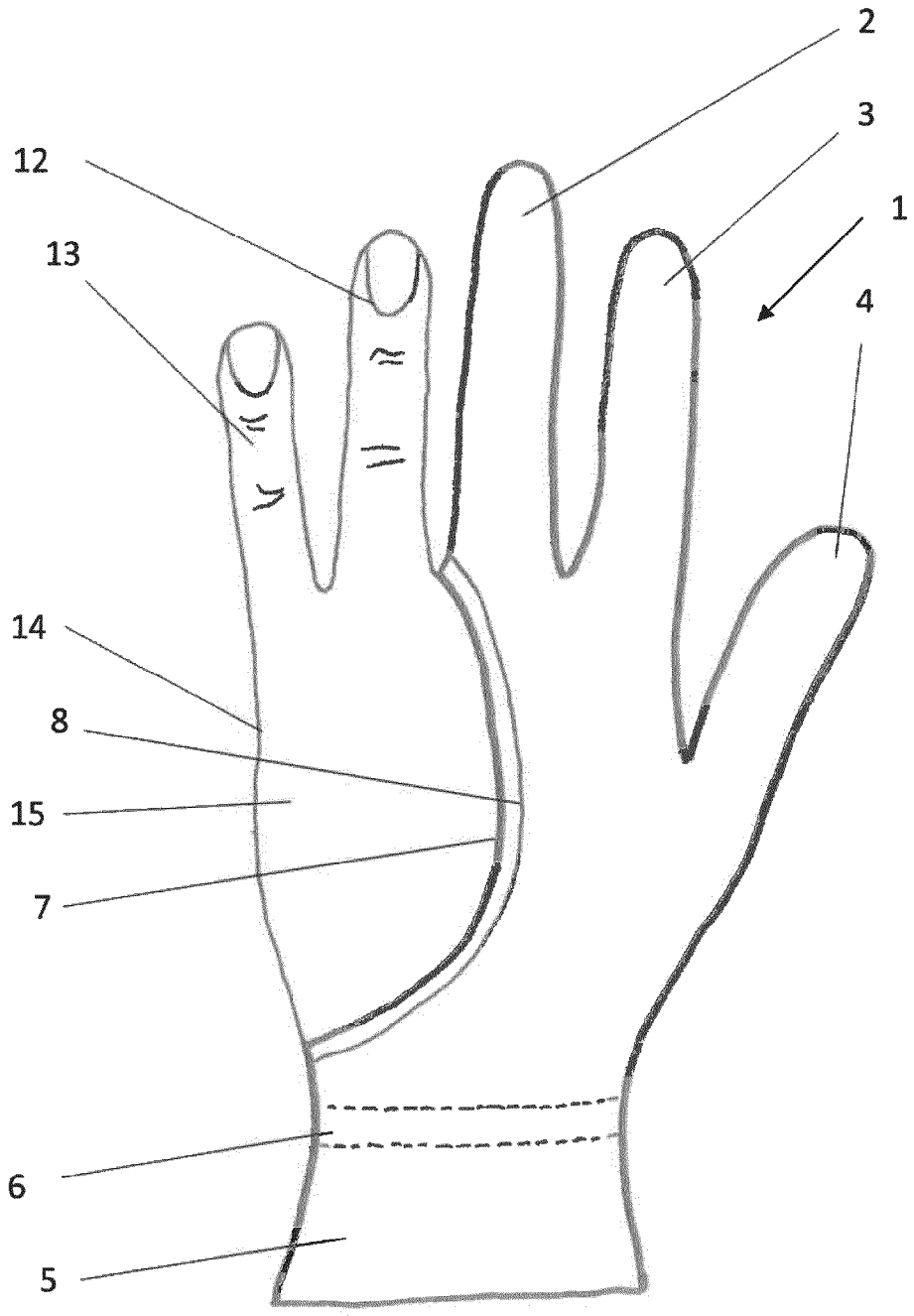
FIG. 4 shows a representation of the glove on one hand.

While the glove according to FIGS. 1, 3 and 4 is made of any optional, preferably fine, light and breathable material, an exemplary embodiment is shown in FIG. 2, in which the palm is littered with rubber studs.

It goes without saying that also an entire rubber layer or only a rubber layer in the area of the finger tubes 2, 3 and 4 can be formed.

FIG. 3 shows variations in the area of the cuff. Thus, the cuff can be formed by a strap 9, which for example comprises a Velcro fastener area 10. Another embodiment can comprise an elastic band area 11 formed by sewing in elastic threads.

The respective cut-out 7 of each shown glove is provided with a seaming 8 and is sufficiently stabilised in this manner. As FIG. 4 shows, the ring finger 12 and the little finger 12 as well as the edge of the hand 14, a big part of the back of the hand 15 and the corresponding not shown part of the palm are thus free. Simultaneously, the glove 1 fits closely on the hand, also in the area of the recess 7.

The described exemplary embodiments only serve for explanation and are not limiting.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A glove comprising three receiving tubes for a thumb, an index finger and a middle finger of a hand, wherein said tubes are joined together and are combined together with a first region adjacent to the edge of the thumb on the hand to form a wrist cuff so that a cut-out remains which exposes a ring finger, a little finger, an edge of the hand and second and third adjacent regions of the palm and the back of the hand, wherein the cut-out is seamed in a stabilizing manner, wherein a seaming of the cut-out is elastic and the cut-out is dimensioned, such that the glove can be pulled off the fingers and can be positioned such that it remains on the wrist by means of the cuff.

2. The glove according to claim 1, wherein the glove is at at least partially made of a light, breathable material.

3. The glove according to claim 1, wherein the glove is at least partially made of a paper fibre material.

4. The glove according to claim 1, wherein the glove is at least partially made of an antistatic material.

5. The glove according to claim 1, wherein the cuff is configured to be elastic.

6. The glove according to claim 5, wherein the cuff comprises an elastic band.

7. The glove according to claim 1, wherein the cuff comprises a closable strap.

8. The glove according to claim 7, wherein the strap includes a hook and loop fastener.

9. The glove according to claim 1, wherein the outer sides of the receiving tubes, which are directed to the palm, are at least partially coated with an anti-slip material.

10. The glove according to claim 9, wherein the outer sides of the receiving tubes, which are directed to the palm, are coated with rubber studs.

11. The glove according to claim 1, wherein fingertip areas of the receiving tubes are at least partially reinforced.

* * * * *